US005954115A

United States Patent [19]

Lebensfeld et al.

[11] Patent Number: 5,954,115

[45] Date of Patent: Sep. 21, 1999

[54] MOLDING TOY FOR MOLDING TOY METAL OBJECTS

[76] Inventors: Steven Lebensfeld, 45 Wildwood Dr., Laurel Hollow, N.Y. 11791; Frank Landi, 28 Schenck Ave., Great Neck, N.Y. 11021; Harold Wells, 33 School La., Huntington, N.Y. 11743

[21] Appl. No.: 08/795,655

[22] Filed: Feb. 6, 1997

[51] Int. Cl.[6] ..... B22D 23/06; B22D 41/01; B22D 46/00

[52] U.S. Cl. ..... 164/152; 164/136; 164/250.1; 164/336

[58] Field of Search ..... 164/136, 336, 164/152, 153, 250.1; 425/DIG. 57, 161; 446/491

[56] References Cited

U.S. PATENT DOCUMENTS

| | | | |
|---|---|---|---|
| 1,456,298 | 5/1923 | Carnes . | |
| 2,025,069 | 12/1935 | Newton . | |
| 2,195,960 | 4/1940 | Morris . | |
| 2,897,555 | 8/1959 | Nishikiori . | |
| 3,063,109 | 11/1962 | Rapaport . | |
| 3,179,980 | 4/1965 | Ryan et al. . | |
| 3,468,366 | 9/1969 | Suddarth . | |
| 4,215,843 | 8/1980 | Gay et al. . | |
| 4,299,548 | 11/1981 | Saffer et al. . | |
| 5,315,091 | 5/1994 | O'Brien et al. | 164/250.1 X |
| 5,441,396 | 8/1995 | Nicetto | 164/153 X |
| 5,451,745 | 9/1995 | Goldberg et al. . | |
| 5,453,000 | 9/1995 | Lebensfeld . | |
| 5,528,014 | 6/1996 | Goldberg et al. . | |
| 5,560,940 | 10/1996 | Breuil . | |
| 5,597,593 | 1/1997 | Lebensfeld et al. . | |
| 5,634,514 | 6/1997 | Gagliano | 164/136 X |

FOREIGN PATENT DOCUMENTS

| | | | |
|---|---|---|---|
| 3521086 | 12/1986 | Germany . | |
| 58-215264 | 12/1983 | Japan | 164/136 |

*Primary Examiner*—J. Reed Batten, Jr.
*Attorney, Agent, or Firm*—Cowan, Liebowitz & Latman, P.C.

[57] ABSTRACT

The toy uses metal molding material having a relatively low melting point which produces realistic toy metal objects. The metal is heated in a crucible and poured into a preferably closed, flexible mold made of rubber. The crucible and the mold are mounted to a molding platform held in a fixed position relative to each other with an outlet of the crucible communicating with an inlet of the mold. The molding platform is pivotally mounted in the toy, and both the crucible and the mold are pivoted or tilted to allow liquefied metal in the crucible to flow into the mold. A crank mechanism pivots the molding platform. The toy has a removable inner cover which mounts to the molding platform to cover the crucible and the mold, and a pivotally mounted outer cover which when closed blocks access to the molding platform and the inner cover. The toy has a number of interlocks, namely an interlock which locks the outer cover closed in response to temperature within the toy, an interlock which prevents pivoting of the molding platform if the outer cover is not closed, an interlock which prevents opening of the outer cover if the power switch is on, and an interlock which prevents rotation of the crank if the outer cover is not closed and prevents opening the outer cover once the crank has been rotated out of a home position corresponding to a horizontal position of the molding platform.

34 Claims, 10 Drawing Sheets

MOLDING TOY FOR MOLDING TOY METAL OBJECTS

BACKGROUND OF THE INVENTION

The invention disclosed herein relates to a molding toy, a toy molding process and a mold for molding or casting toy objects, particularly toy metal objects.

Many toy molding processes require heat either to liquefy or cure (set) the molding material, and many molding toys include a toy oven to provide the heat. Molding materials with relatively low melting points have been selected for use in toy molding processes which liquefy a molding material that is normally solid at room temperature for safety, cost and other reasons. See for example, U.S. Pat. Nos. 4,299,548 and 4,215,843. Such low melting point molding materials used in molding toys heretofore have been plastics. Because such plastic materials are of low density, the toy objects molded from them are of low density and lightweight. This detracts from play value and enjoyment because many lightweight toy objects do not seem realistic, for example toy vehicles and toy jewelry items.

Another deficiency in molded toy objects made from plastic materials using toy molding processes is that they typically lack fine detail, as compared to commercial molded objects and objects molded from plaster of Paris, although U.S. Pat. No. 5,597,593, discussed below, discloses a molding toy which molds plastic toy objects with fine detail using a three-piece mold set having undercuts (projections and recesses which are perpendicular to the angle of draw, i.e., the direction in which the mold is opened). Without such detail some toy objects may not seem realistic, which detracts from the play value of the molded toy objects.

Realism in toys usually increases the play value of the toys, as the two characteristics described above suggest. However, not only do realistic toy objects have high play value, but so also does a toy that enables a child to make realistic toy objects, since there would normally be more play value in making a realistic or fun toy than a crude one. The ability of a child to make something realistic or with which the child can have fun simply adds to the play value of the toy. The Creepy Crawler® line of molding toys, sold by the assignee of this application (Toymax Inc., Westbury, N.Y.) demonstrates this. That line uses a plastisol molding material (Plasti-Goop®) and molds with insect shapes (among a great many others) from which a child may mold insect-looking and otherwise creepy objects. The cured plastisol is flexible, and objects like spiders may be made with thin flexible legs. The Creepy Crawler® toy provides play value when a child makes the molded toy objects and when the child plays with the molded objects.

A toy which would enable a child to make realistic molded objects from metal would provide the dual play value described above. However, high temperatures are required to liquefy most metals which present certain problems in toys such as cost and the risk of injury from hot parts within the toy or spilled hot molding material, or a hot just molded object, and from electrical shock. While toy ovens, for example the toy ovens disclosed in U.S. Pat. No. 5,451,745, may include interlock mechanisms which preclude access to an interior heatable chamber when it is hot or when the power switch is on, these ovens may not be suitable for liquefying most, if not all, metals, and have not addressed the spillage problem.

The toy mold system disclosed in U.S. Pat. No. 5,597,593, mentioned above, can be used to make fully configured molded plastic toy objects with fine detail and with undercuts. That mold system comprises rigid mold sections, disclosed to be preferably made of metal. The molding material, a plastic, is introduced in the molding system as a solid, and the mold system is heated to liquefy the molding material directly in the mold system. Tremendous play value is achieved because toy objects such as miniature cars may be formed with great detail and with undercut portions, and from a plastic molding material that is rigid when it solidifies. However, more play value could be obtained with a toy that can form highly detailed toy objects, which preferably have undercuts, which require more interactivity from a child using the toy and which molds metal objects.

There is a need for a molding toy which, individually and collectively, can mold toy objects of metal, can mold highly detailed toy objects, with undercuts, is highly interactive, includes one or more appropriate interlocks, greatly reduces or eliminates the risk of spillage of hot liquefied molding material, and is relatively inexpensive to make. The invention provides such a toy, an embodiment of which is presently being sold by Toymax Inc. of Westbury, N.Y., the assignee of this application, under the trademarks "Metal Molder" and "Die Cast Factory".

OBJECTS AND SUMMARY OF THE INVENTION

It is an object of the invention disclosed herein to provide a toy and toy process for molding or casting toy metal objects.

It is another object of the invention to provide such a toy and toy process which use a metal molding material which has a relatively low melting point.

It is another object of the invention to provide a toy for molding toy metal objects which prevents access to interior regions of the toy while they are above a given temperature and permits hot liquefied molding material to be transferred from a heating location into a mold. Another object is to provide such a toy which has a simple mechanism for transferring hot liquefied molding material from a heating location into the mold.

It is another object of the invention to provide a molding toy which can be used to mold toy objects with fine detail, and even with undercuts. Another object is for such a toy to provide high child/toy interactivity in the molding process.

It is another object of the invention to provide a more interactive molding toy by heating the molding material outside of the mold to liquefy it, and requiring that hot liquefied molding material be transferred into a closed mold. Another object is to provide such a toy which substantially reduces or eliminates the risk of spillage of hot liquefied molding material. Another object is to increase interactivity by providing distinct molding steps such as selecting and inserting a mold, loading the mold, closing one or some covers, heating the molding material, pouring the liquefied molding material into the mold, cooling the mold, etc.

The invention provides a molding toy, a molding process and a mold system for molded toy objects, particularly of metal, which individually and in combinations achieve individual and combinations of the above and other objects.

To provide much of the play value described above, a metal molding material is used, and to operate the inventive molding toy and process at relatively low temperatures, a low melting point metal is used. In accordance with the invention, the preferred molding material is a bismuth-tin alloy known in the art by the tradename Eutectic Alloy, which is available from Metal Specialties. Other metals such as indium may be used, but they are much more expensive than Eutectic Alloy. The melting point of Eutectic Alloy is 281° F., and the preferred temperature range for molding Eutectic Alloy in accordance with the invention is from about 282° F. to about 400° F. The preferred physical form of Eutectic Alloy is in small pellets about the size of bee-bees. Selection of Eutectic Alloy allows relatively low temperatures to be used to mold metal toy objects, and allow the toy to be made inexpensively and the molding process to be carried out inexpensively.

A molding process according to the invention comprises selecting a low melting point metal such as Eutectic Alloy or indium, introducing the metal in a mold either in solid or liquid form, heating the selected metal to liquefy it either prior to or after introduction thereof into the mold, cooling the liquefied metal to solidify it, and removing the solidified metal from the mold. In a preferred embodiment, the metal is heated in a first container or crucible, and poured into the mold, which preferably is a closed mold. In the preferred embodiment, the crucible and the mold are held in a fixed position relative to each other with an outlet of the crucible communicating with an inlet of the mold, and both the crucible and the mold are pivoted or tilted together to allow liquefied metal in the crucible to flow into the mold with no or very little spillage. Essentially eliminating spillage of hot liquefied metal, even at the lower temperatures involved here, reduces the risk of injury to a child playing with the toy. The method may also include selecting a mold from a number thereof, mounting it into the toy, and removing it from the toy after the metal or other molding material introduced therein has cooled.

A molding toy according to an embodiment of the invention comprises a base, a crucible pivotally mounted to the base for movement between a horizontal position and at least one inclined position, and a mold mounted to the base such that the mold receives liquefied molding material flowing through an outlet of the crucible in the at least one inclined position of the crucible.

In the preferred embodiment, the molding toy comprises a molding carrier or platform pivotally mounted to the base for movement between the horizontal position and the at least one inclined position. The molding platform carries the crucible which moves therewith and a mold which also moves therewith. The crucible and the mold are carried by the platform in a fixed relationship to each other with an inlet of the mold being positioned adjacent the crucible outlet to receive liquefied molding material passing through the crucible outlet. The crucible outlet (e.g., a spout or runner) is configured and positioned such that with a given quantity of liquefied molding material in the crucible, liquefied molding material will not pass therethrough when the platform is in the horizontal position but will pass therethrough when the platform is in the at least one inclined position. This arrangement reduces the risk of spillage of hot liquefied molding material.

The molding toy also comprises a heater positioned to heat molding material in the crucible, and the heater may be carried by the platform to move therewith in a fixed relationship with the crucible. The mold is preferably removably carried by the molding platform and the molding platform comprises a receptacle for removably receiving the mold.

In a preferred embodiment, the molding toy comprises two movable covers. An inner cover is movably mounted to the base and in a first position thereof covers at least the crucible such that the cover substantially prevents spillage of liquefied molding material through an open top of the crucible, and in a second position permits introduction of molding material into the crucible through the open top thereof. An outer cover is movably mounted to the base and in a closed position blocks access to the inner cover and in an open position thereof permits access to the inner cover. The inner cover is preferably removably mounted to the base and in the second position thereof is separated from the base, and the outer cover is preferably pivotally mounted to the base and in the open position thereof is pivoted sufficiently from the closed position thereof to permit access to the inner cover.

In the preferred embodiment, the mold is positioned and the outer cover is configured to block access to the mold in the closed position of the outer cover.

An interlock is provided responsive to heat generated by the toy's heating device to prevent the outer cover from being moved out of the closed position when the temperature in a heating area of the toy is above a given temperature. This interlock may comprise structure associated with the outer cover and the base that engage and disengage when the outer cover is moved into and out of its closed position.

An interlock may also be provided which prevents the crucible from being pivoted when the outer cover is not in its closed position. This interlock may comprise structure associated with the cover and the crucible or a carrier for the crucible, and/or with the base that engage and disengage in response to movement of the outer cover into and out of the closed position.

Still another interlock may be provided which prevents electrical power from being coupled to the heating device when the outer cover is not in its closed position and/or which prevents the outer cover from being moved out of its closed position unless the electrical power to the toy or to the heating device is switched off.

The toy molding device may also have an interlock which prevents the mechanism which pivots the crucible from being activated unless the outer cover is in its closed position. The crucible may be carried by a molding platform which maybe tilted by a crank mechanism, and this (crank/cover) interlock may prevent the crank from turning unless the outer cover is in the closed position, and/or may prevent the outer cover from being pivoted out of the closed position unless the crank is in a locked or home position.

The combination of covers and interlocks prevents access to hot liquefied molding material and parts within the toy and ensures that hot liquefied molding material will not be spilled outside of the toy.

The molding toy may also have a closed toy mold system for molding therein toy objects, which comprises a mold having two flexible mold parts each having a mold cavity in the central region thereof and a peripheral flange surrounding the mold cavity. The mold parts are configured to define a common mold cavity formed by the mold cavities of the two mold parts when the two mold parts are in a joined condition positioned together with respective peripheral flanges contacting each other. Each of the flanges has a plurality of holes therethrough with pairs of holes in the respective flanges being aligned when the two mold parts are in the joined condition. The mold system includes a mold receptacle which receives the mold parts in the joined condition with the holes aligned. A plurality of pins project from the periphery of the receptacle positioned to pass through aligned holes in the flanges of the mold parts when the mold parts are received in the receptacle in the joined condition, and a cover is movably attached over an open end of the receptacle to press the mold parts together with the opening to the mold exposed to receive liquefied molding material when the mold is received in the receptacle in the joined condition thereof. The flexible mold system may have undercuts.

BRIEF DESCRIPTION OF THE DRAWINGS

The invention is illustrated in the figures of the accompanying drawings which are meant to be exemplary and not limiting, in which like numerals throughout the figures refer to like or corresponding parts, and in which.

DESCRIPTION OF THE PREFERRED EMBODIMENTS

Figure 1:
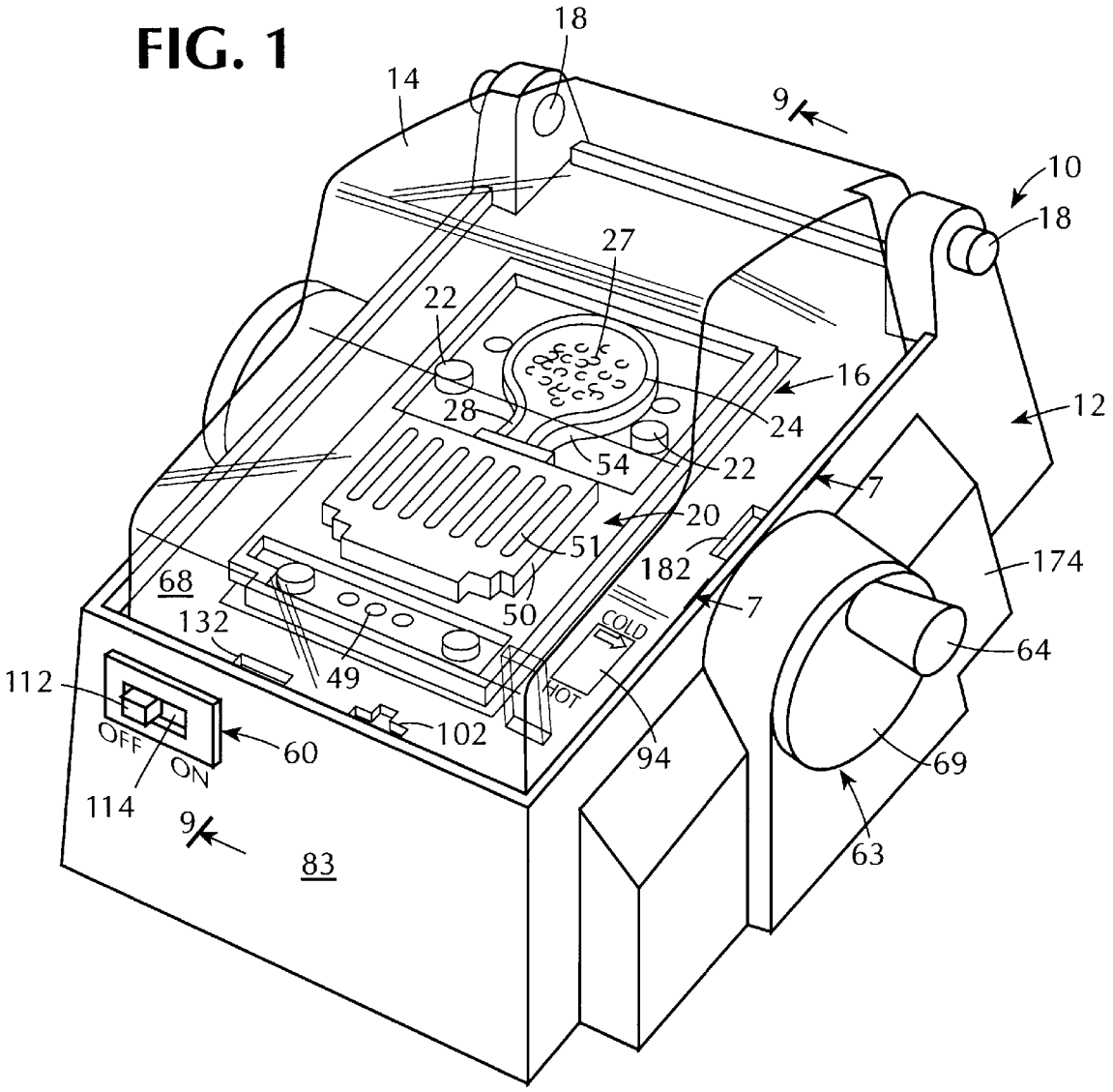
FIG. 1 is a perspective view of a molding toy according to one embodiment of the invention shown with its outer cover in its closed position.
Figure 2:
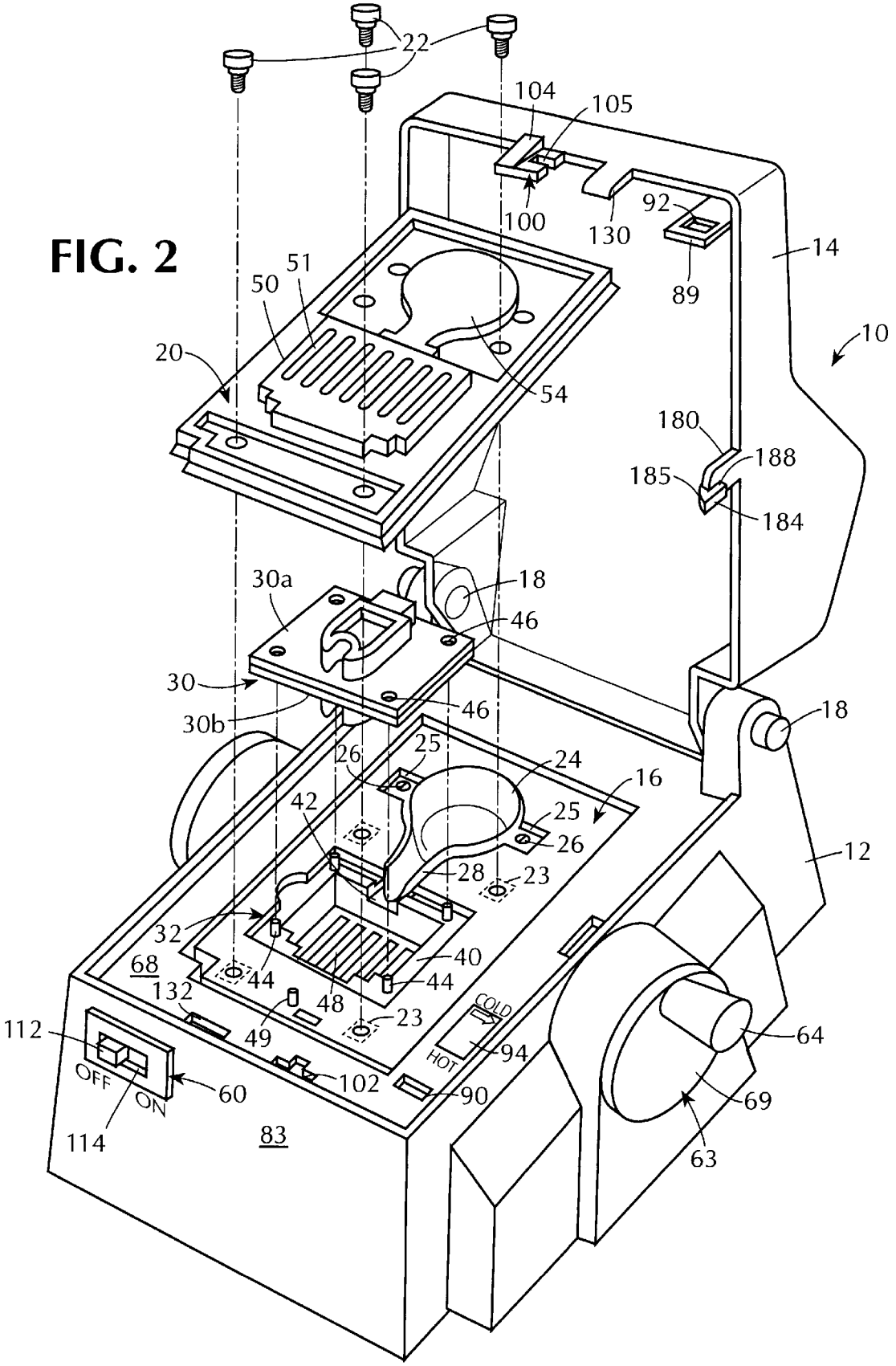
FIG. 2 is an exploded perspective view of the molding toy depicted in FIG. 1 with its outer cover opened.

Referring to FIGS. 1 and 2, the molding toy 10 according to one embodiment of the invention has a base 12, an outer cover or door 14, and a molding platform 16 pivotally mounted to the base 12 below the outer cover 14. The outer cover 14 is preferably transparent and is pivotally attached to the base 12 by spaced pivots 18. An inner cover (molding platform cover) 20 is removably attached to the molding platform 16 by a plurality of thumbscrews 22 and nuts 23 retained in the molding platform 16. The molding platform cover 20 preferably also is transparent.

A crucible or ladle (or oven) 24 (FIG. 2) is mounted to the molding platform 16 by means of brackets 25 attached to the outer sides of the crucible and fastener devices 26 each comprising a screw and a threaded clip nut engaged with the molding platform 16. The crucible 24 holds molding material 27 (FIG. 1) (described above) which is heated and liquefied in the crucible, and has an outlet in the form of a spout or runner 28 (FIG. 2) through which liquefied molding material is removed from the crucible 24 and introduced into a mold 30 removably held in a mold receptacle 32 in the molding platform 16. As shown in FIGS. 2–4 and 9, the spout 28 extends into the mold receptacle 32 where it enters the inlet 34 of the mold 30.

Referring to FIGS. 2–4 and 9, the mold 30 comprises two mold sections 30*a* and 30*b* each having mold cavity 36*a*, 36*b* which together form a common mold cavity 36 which defines the shape of the object to be molded. Each of the mold sections 30*a*, 30*b* includes a peripheral flange 38*a*, 38*b* surrounding the respective mold cavity 36*a*, 36*b* and an inlet channel 34*a*, 34*b* in a respective flange 38*a*, 38*b* leading to a respective mold cavity 36*a*, 36*b*. In a closed condition of the mold (FIG. 9), the mold cavities 36*a*, 36*b* align to define the common mold cavity 34, the channels 34*a*, 34*b* align to define the inlet 34, and the peripheral flanges 38*a*, 38*b* abut each other. The mold sections 30*a*, 30*b* are flexible and are made of an elastomeric material which is non-reactive with the molding material 27 and can withstand the molding temperatures involved, for example, natural rubber. However, a rigid mold may be used if the mold cavity does not have undercuts or if a molding material is used which is flexible or compressible when it solidifies.

The mold receptacle 32 (FIGS. 2 and 9) is defined by recess in the molding platform 16 generally rectangular in cross section having a peripheral step or shoulder 40 therein. The mold receptacle 32 is sized and configured to receive all or most of the mold 30 therein with the mold peripheral flanges 38*a*, 38*b* seated on the recess peripheral shoulder 40. A channel 42 is provided in the peripheral shoulder 40 and is configured to receive therein the inlet channel 34*b* of the mold section 34. A plurality of spaced guide pins 44 (FIGS. 2 and 3) project from the peripheral shoulder 40 and pass through aligned pairs of holes 46 in the peripheral flanges 38*a*, 38*b* to locate the mold 30 in the mold receptacle 32 and help hold it therein. The bottom of the mold receptacle 32 (FIGS. 2 and 5) has slotted openings 48 therein which communicate the mold receptacle 32 with the interior of the base 12 for ventilation of the mold receptacle 32.

Figure 9:
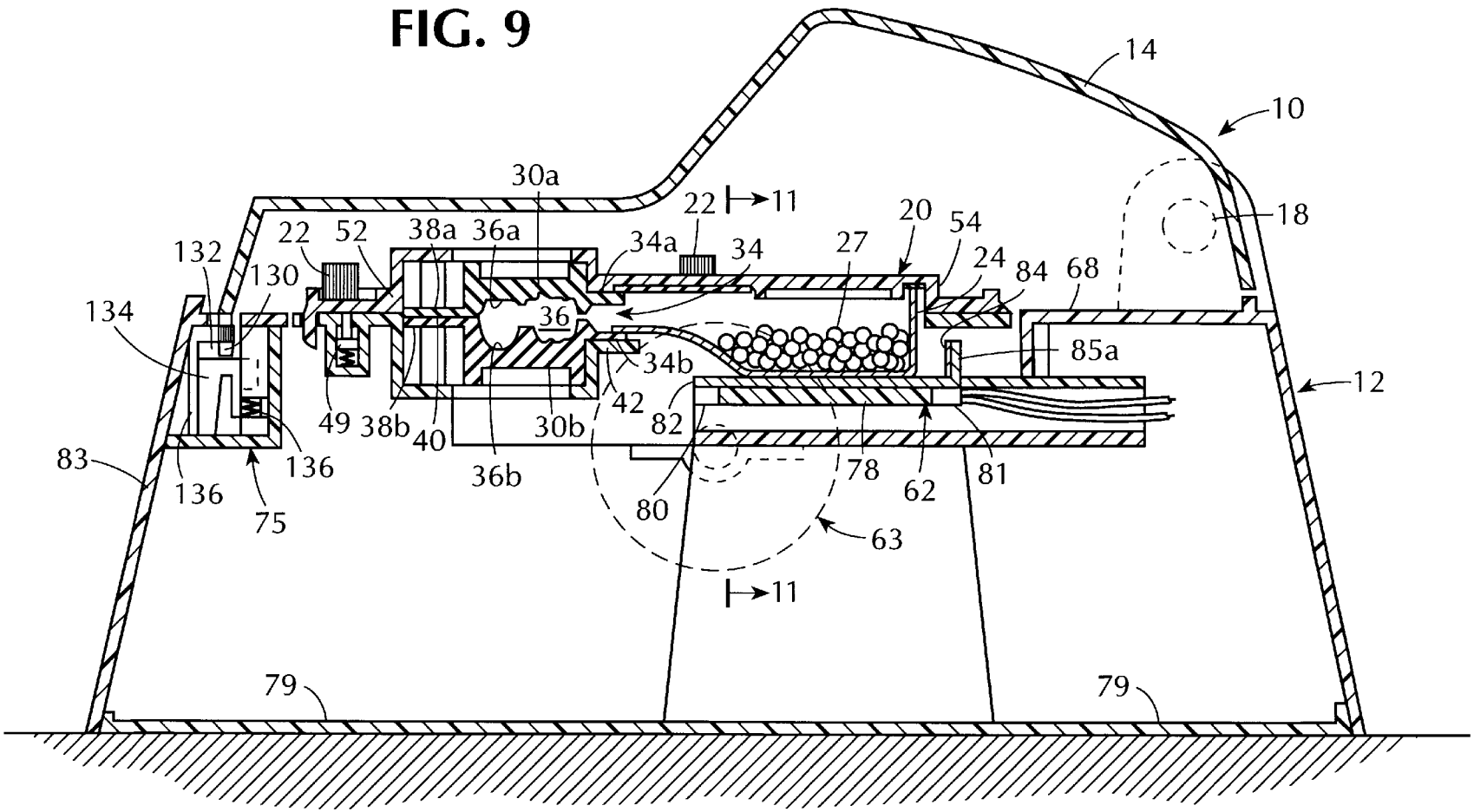
FIG. 9 is a section view of the molding toy depicted in FIG. 1 taken through line 9—9 therein showing the molding platform horizontal.

The molding platform cover 20 includes a portion 50 (FIGS. 1 and 2) with slotted openings 51 positioned over the mold receptacle 32 when the cover 20 is attached to the molding platform 16. Like the slotted openings 48, the slotted openings 51 are for ventilation of the mold receptacle 32. Referring to FIG. 9, the cover portion 50 is stepped and includes a peripheral portion 52 which engages the peripheral flanges 38*a*, 38*b* of the mold parts 30*a*, 30*b* when the cover 20 is attached to the molding platform 16.

The molding platform cover 20 also has a stepped portion 54 (FIGS. 1, 2 and 9) shaped to receive the top of the crucible 24 and spout 28 therein when the cover 20 is attached to the molding platform 16 to prevent or substantially prevent spillage of liquefied molding material 27 from the crucible 24 (except through spout 28) when the molding platform 16 is tilted as described below. A tight fit of the molding platform cover 20 on the molding platform 16 is achieved when the thumbscrews 22 are tightened. However, a gasket (not shown) is preferably provided extending about the periphery of the stepped portion 54 held thereat to prevent leaking of liquefied molding material past the stepped portion 54. The molding platform 16 includes a spring-loaded pin 49 (FIGS. 1–5 and 9) in the top thereof to push the molding platform cover 20 off the molding platform and above the edge of the front wall 83 of the base 12 when the thumbscrews 22 are released, which allows the cover 20 to be easily grasped and removed.

Figure 3:
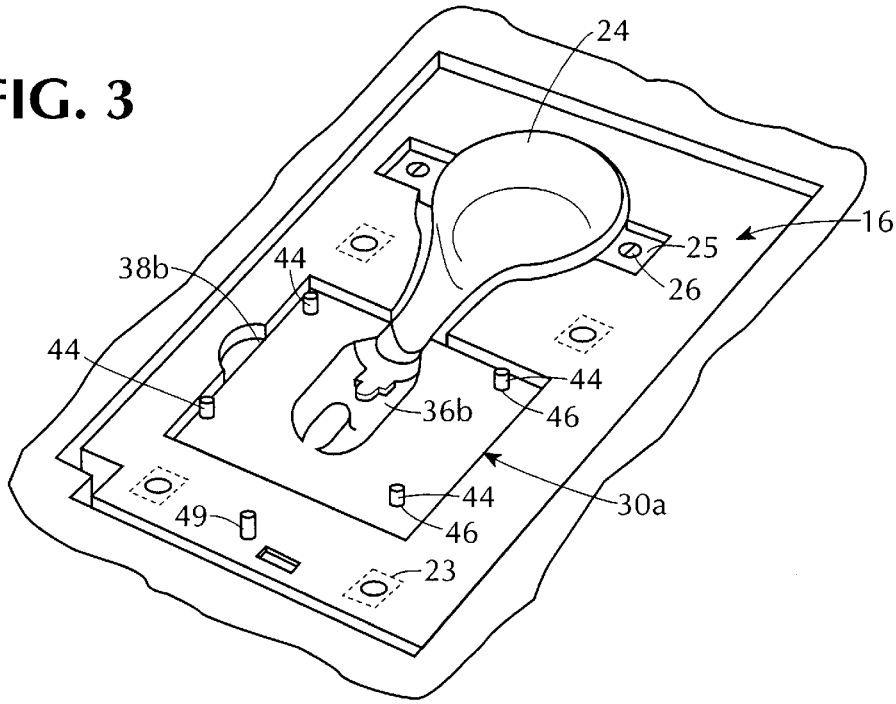
FIG. 3 is an enlarged perspective view of a portion of the molding toy depicted in FIG. 1 showing a molding platform to which are mounted a crucible for heating molding material and a mold receptacle with a mold section therein.
Figure 4:
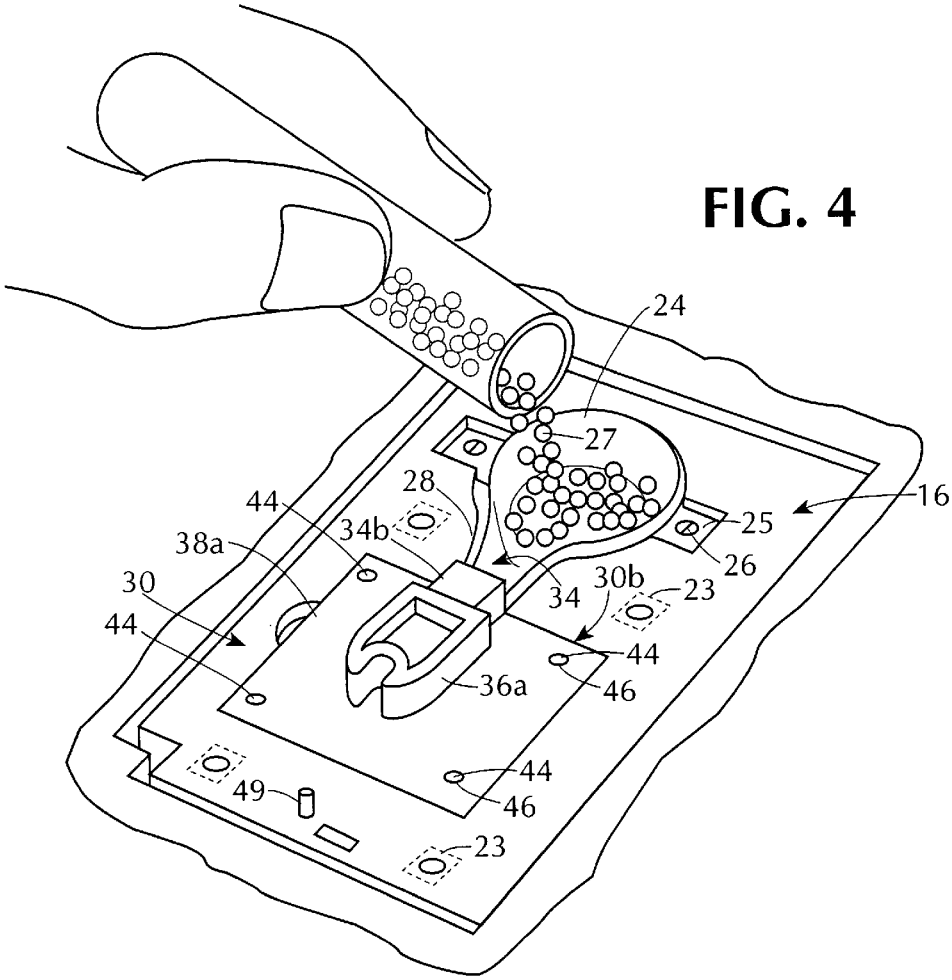
FIG. 4 is a perspective view similar to that of FIG. 3 showing pellets of molding material being deposited into the crucible.
Figure 10:
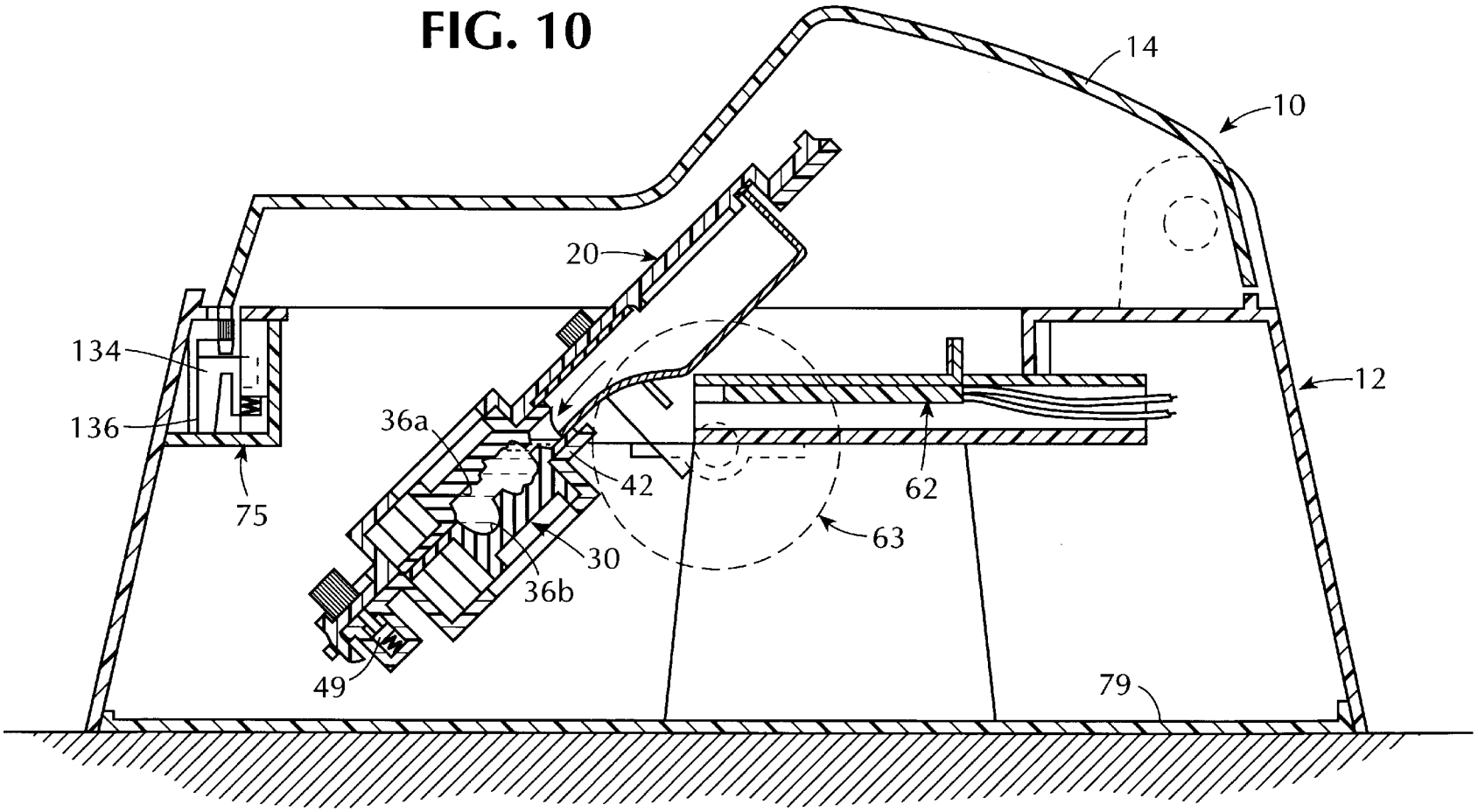
FIG. 10 is a section view similar to that of FIG. 9 but with the molding platform tilted.

As shown in FIGS. 2–4 the crucible 24 and the mold receptacle 32 are fixed relative to each other in (on) the molding platform 16, and are in the same fixed relationship relative to each other when the molding platform 16 is horizontal (FIG. 9) and when it is tilted (FIG. 10). A mold 30 held in the mold receptacle 32 similarly is in a fixed relationship relative to the crucible 24. With the top of the crucible 24 closed by the molding platform cover 20 and the mold 30 held closed by the molding platform cover 20, the risk of spillage of liquefied molding material from the crucible and the mold is substantially if not entirely eliminated.

The base 12, the outer cover 14, the molding platform cover 20 and the molding platform 16 may each be homogeneous one-piece molded parts of a suitable plastic or plastics. The molding platform 16 and the molding platform cover 20 are made of a plastic which will withstand the molding temperatures involved. The crucible 24 is made of a material which is non-reactive with the molding material 27 and which will withstand the molding temperatures involved, e.g., stainless steel.

The molding toy 10 is used as follows. A mold 30 is selected having a mold cavity 36 shaped to form the desired object and a mold powder (not shown) is applied to the mold cavities 36*a*, 36*b* of the mold 30. With the outer cover 14 opened and the molding platform cover 16 removed, the mold section 34*b* is inserted into the mold receptacle 32 as shown in FIG. 3. The mold section 34*a* is inserted into the mold receptacle 32 to close the mold 30 with the crucible spout 28 extending into the mold inlet 34 as shown in FIG. 4, and pellets of molding material 27 are introduced into the crucible 24 through the open top thereof. The molding platform cover 20 is attached to the molding platform 16 by thumbscrews 22 (FIGS. 1 and 9) and the outer cover 14 is closed.

As shown in FIG. 1, the molding toy 10 has a switch referenced generally by 60 which controls power to a heating device 62 (FIG. 9). In its on position (FIG. 1 shows the off position), AC line power is supplied to the heating device 62 to heat the molding material 27 in the crucible 24. As mentioned above, the molding platform 16 is pivotally mounted to the base 12. When the molding material 27 liquefies (e.g., in 10–12 minutes), the molding platform 16 is tilted by turning crank 63 by its handle 64 in a first direction to cause the liquefied molding material 27 to enter the mold 30 as shown in FIG. 10. The switch 60 is turned off after the molding material fills the mold 30 and the molding platform 16 is maintained tilted while the molding material 27 in the mold 30 solidifies.

After the molding material 27 has solidified in the mold 30 (e.g., in 10–12 minutes), the crank 63 is turned in the opposite direction to again position the molding platform 16 horizontally (FIG. 9). After the crucible 24 has cooled (and also the solidified molding material in the mold 30), the outer cover 14 can be pivoted open, the molding platform cover 20 can be removed and the mold 30 can be removed either by first removing the upper mold section 30*a* or by removing the entire mold 30 together. Separating the mold sections 30*a*, 30*b* allows the molded object to be manually stripped from the mold. The molded object may have a protruding portion (runner) corresponding to the inlet 34 of the mold 30 which can easily be snapped off.

Figure 5:
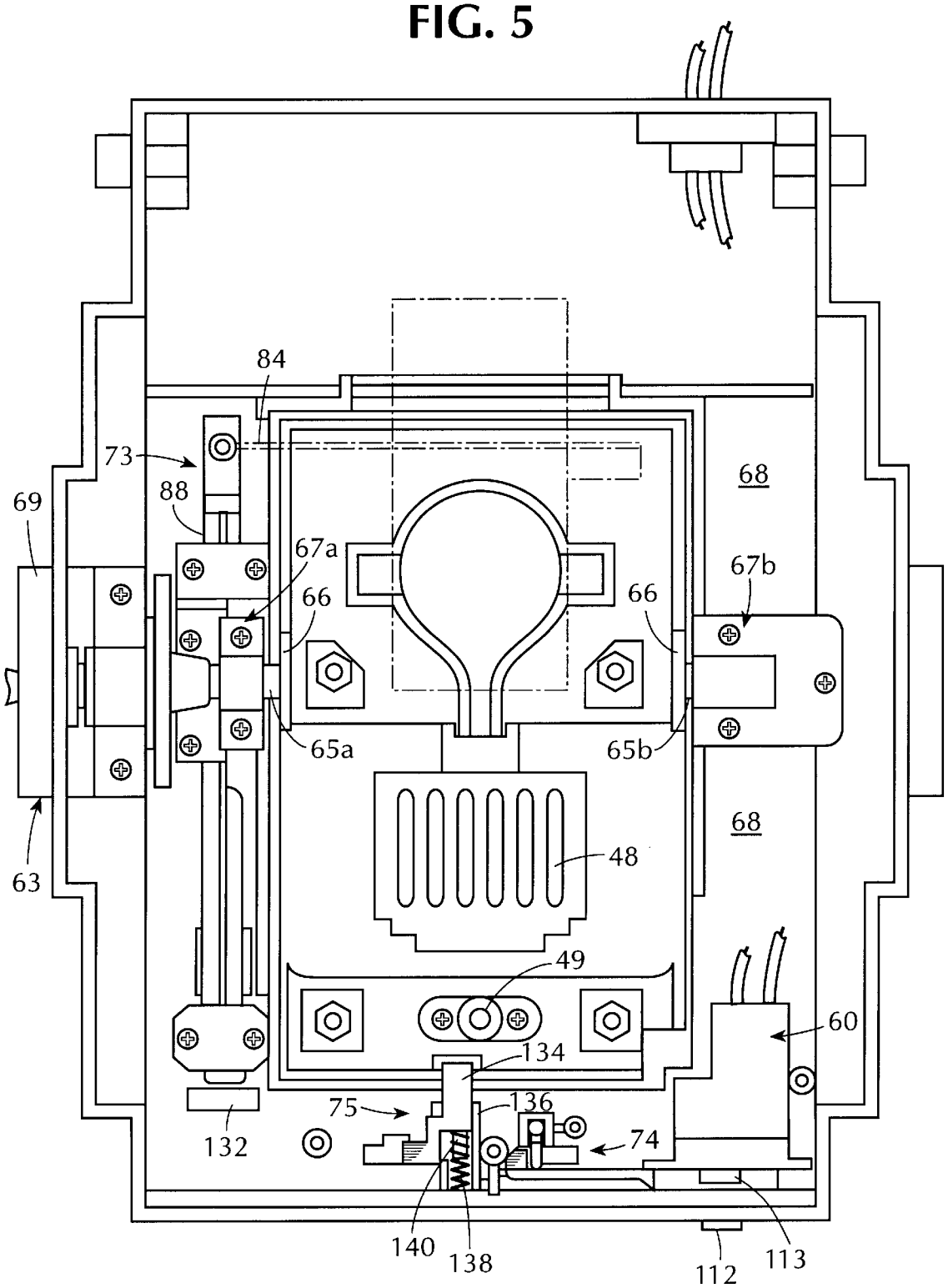
FIG. 5 is a view of the interior of molding toy depicted in FIG. 1 from the bottom thereof with the bottom cover removed and a heating device shown in broken lines, and with a heat responsive safety interlock and a molding platform interlock shown in locked positions thereof.
Figure 11A:
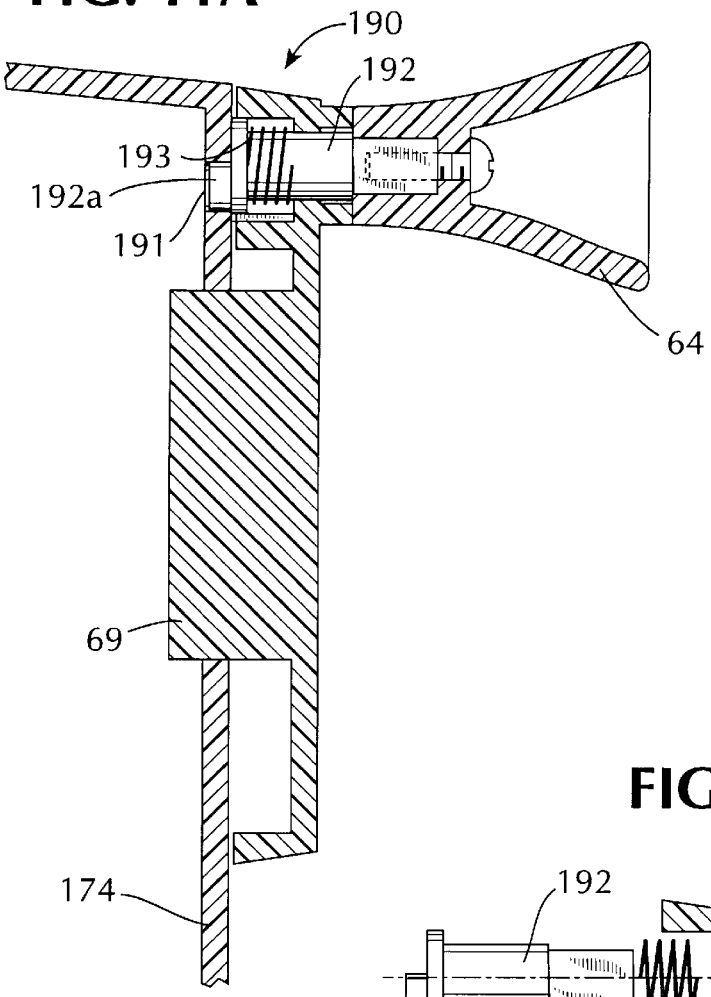
FIGS. 11A and 11B are section views, FIG. 11B being exploded, of a detent mechanism for the crank wheel of the molding toy depicted in FIG. 1.
Figure 11B:
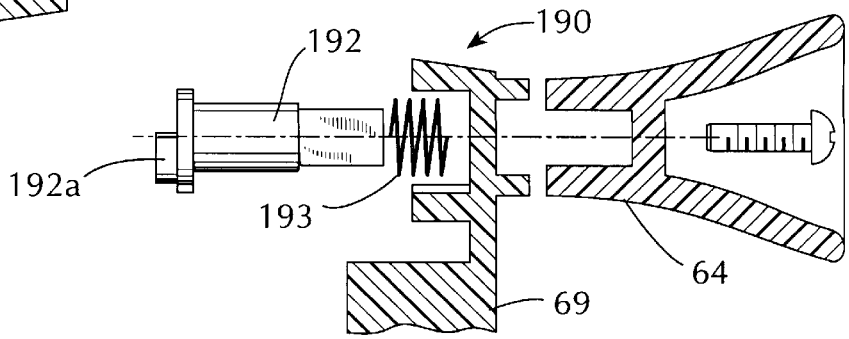
Figure 11:
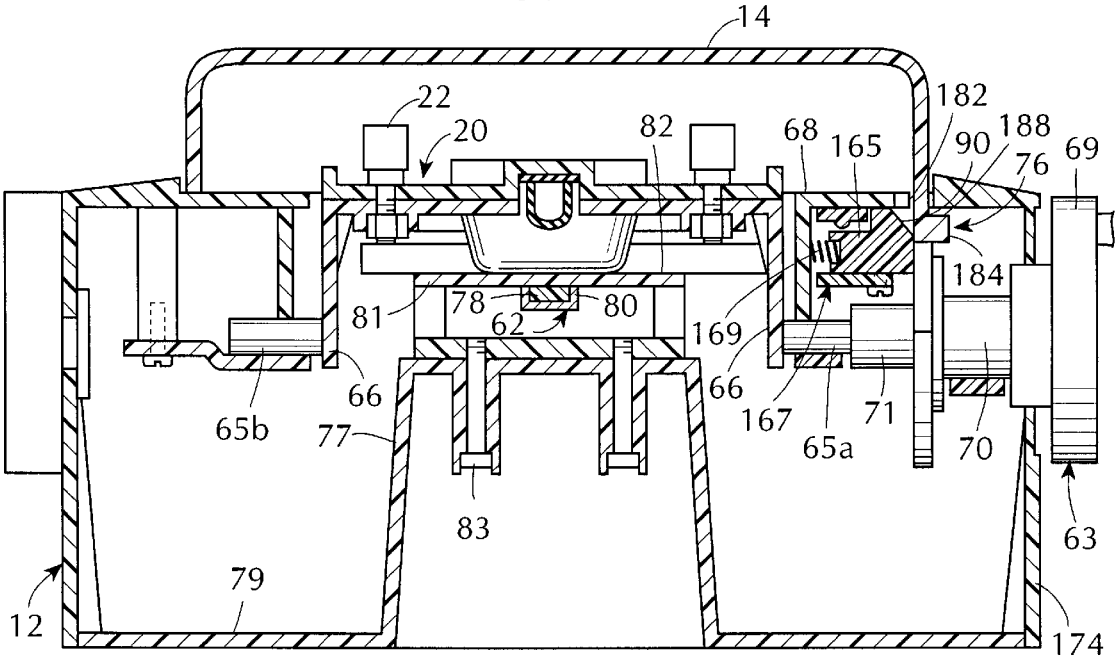
FIG. 11 is a section view of the molding toy depicted in FIG. 1 taken along the line 11—11 in FIG. 9.
Figure 12:
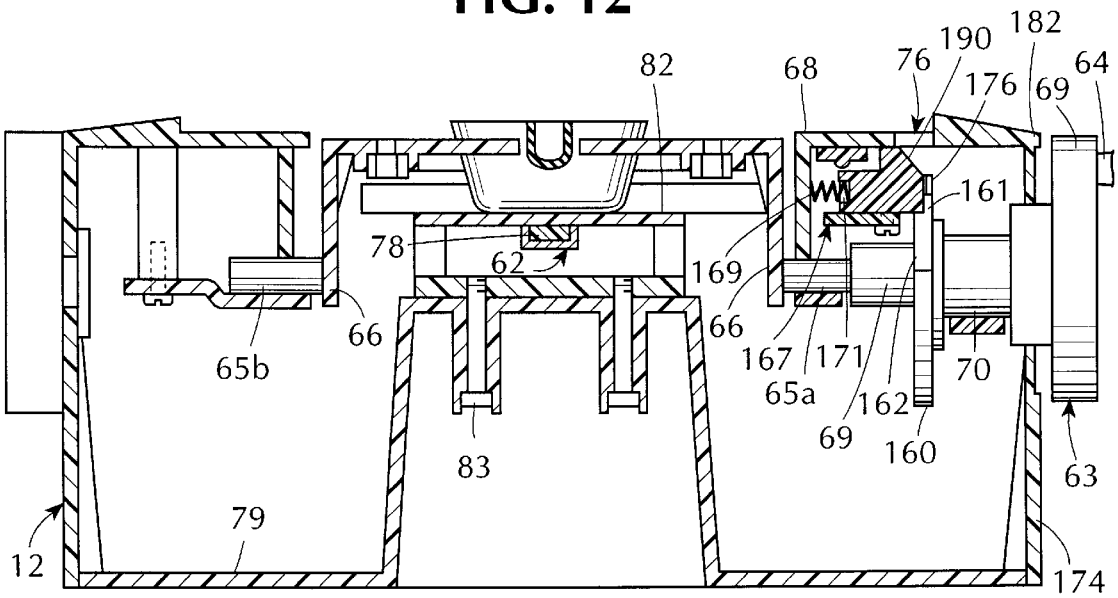
FIG. 12 is a section view similar to that of FIG. 11 but with the inner cover (to the molding platform) removed and the outer cover opened.

Referring to FIGS. 5, 11 and 12, the molding platform 16 is pivotally supported in the base 12 so that it may be tilted as described above. Pivot pins 65*a*, 65*b* extending outwardly from arms 66 depending from the molding platform 16 are received in journals 67*a*, 67*b* mounted to the underside of the base top 68. The crank 63 includes a crank wheel 69, and a crank shaft 70 terminating in a coupling 71 which non-rotatably and axially slidably receives the pivot pin 65*a* therein. Rotation of the crank wheel 69 rotates the pivot pin 65*a*, and thereby tilts the molding platform 16.

The embodiment of the molding toy 10 shown in the drawings has a number of interlocks which prevent opening the outer cover 14 or tilting the molding platform 16, or both. The toy 10 has: (1) a temperature responsive interlock referenced generally by 73 in FIGS. 5, 6, 6A and 9 which prevents the outer cover 14 from being moved out of its closed position until the crucible area has cooled to a safe temperature; (2) a switch interlock referenced generally by 74 in FIGS. 13–15 which prevents the switch 60 from being switched to its on position unless the outer cover 14 is in its closed position and which prevents the outer cover 14 from being pivoted open from a closed position unless the switch 60 is in its off position; (3) a molding platform interlock referenced generally by 75 in FIGS. 5 and 6 which prevents the molding platform from being tilted unless the outer cover 14 is in its closed position; and (4) a crank/cover interlock referenced generally by 76 in FIGS. 7, 8, 10 and 11 which prevents the crank 63 from turning unless the outer cover 14 is in its closed position, and prevents the outer cover 14 from being pivoted open from the closed position unless the crank handle 64 is in a locked position.

Referring to FIGS. 9 and 11, the heating device 62 comprises a conventional electrical resistance heater 78 in a channel 80 formed by a channeled plate 81 having its webs attached to and in contact with a heater plate 82, which in turn is in contact with the bottom of the crucible 24. The electrical resistance heater 78 heats the portion of the heater plate 82 above the channel 80 and the plate 81 which also heat the heater plate 82. The heater device 62 is secured to an upwardly projecting platform 77 of the bottom cover 79 (FIG. 11) by screws 83.

Referring to FIGS. 5, 6, 6A and 9, the temperature responsive interlock 73 comprises a temperature responsive element in the form of a flexible bi-metallic strip 84 which expands and contracts with changes in temperature to move link a 88 into and out of engagement with a locking tab 89 (FIG. 2) depending from the outer cover 14. The bi-metallic strip 84 is attached to a bracket 85 (FIG. 6A) which in turn is attached to the heater plate 82. One end 84*a* of the bi-metallic strip 84 (FIGS. 5 and 6) is attached to the flange 85*a* of the bracket 85 at one end of the bracket 85, and extends therefrom unattached along the length of the bracket flange 85*a* (FIG. 6A) and beyond transversely across the base 12 of the toy 10 terminating at its other end 84*b* in a loop 86 which receives a pin 87 projecting from the link 88 to pivotally connect the bi-metallic strip 84 at its end 84*b* to the link 88.

The link 86 is slidably mounted and supported in the base 12 by brackets 89 (FIGS. 5 and 6) to move forwardly and rearwardly in the base 12. The bi-metallic strip 84 may flex away from and back against the bracket flange 85*a* (FIG. 6A) to slide the link 88 forwardly and rearwardly, respectively. Another flange 85*b* of the bracket 85 (FIG. 6A) is attached to and in contact with the bottom of the heater plate 82, and therefore is at substantially the same temperature as the heater plate 82. Heating the heater plate 82 heats the bracket 85 (and the crucible 24), which causes the bi-metallic strip 84 to expand and flex away from bracket flange 85*a*, which causes the link 88 to slide forwardly into a locking position.

The locking tab 89 (FIG. 2) depending from the front edge of the outer cover 14 enters an opening 90 in the top edge of the front wall 83 of the base 12 when the cover 14 is closed. The tab 89 has a slotted opening 92 therein and the link 88 extends forwardly short of the slotted opening 92 (see FIG. 5) when the crucible 24 (heater plate 82) is cool.

When the crucible 24 (heater plate 82) is heated to a given temperature, the bi-metallic strip 84 bends to slide the link 88 forwardly sufficiently for the forward end of the link 88 to enter the slotted opening 92 in the tab 89 (see FIG. 6), which locks the outer cover 14 in the closed position. The bi-metallic strip 84 remains bent sufficiently to keep the forward end of the link 88 engaged in the slotted opening 92 as long as the temperature to which it is subjected remains above the given temperature, and bends back against the bracket flange 85*a* (FIG. 6A) to slide the forward end of the link 88 out of engagement with slotted opening 92 (FIG. 5) when the temperature to which the bi-metallic strip 84 subjected falls below the given temperature. The temperature responsive interlock 73 thereby locks the outer cover 14 in its closed position when the temperature of the crucible 24 is above a given safe temperature.

The bi-metallic strip 84 may be selected and mounted to lock the cover 14 closed when the heater plate 82 reaches a given temperature and to keep the cover locked closed until the heater plate 82 cools to the given temperature. The given temperature for unlocking and locking may be slightly different due to a hysteresis effect, and will be selected in accordance with safety considerations.

As shown in FIG. 1, a window 94 is provided on the base 12 through which a part of the link 88 is visible. An indicator (e.g., an arrow) is printed or affixed to the top of the link 88 below the window 94, and temperature indications (e.g., "hot", "cold") are printed or affixed to the top 68 of the base 12 adjacent the window 94 so that the position of the link 88 provides an indication of the temperature of the crucible 24 and the link's movement indicates changing temperature.

Figure 13:
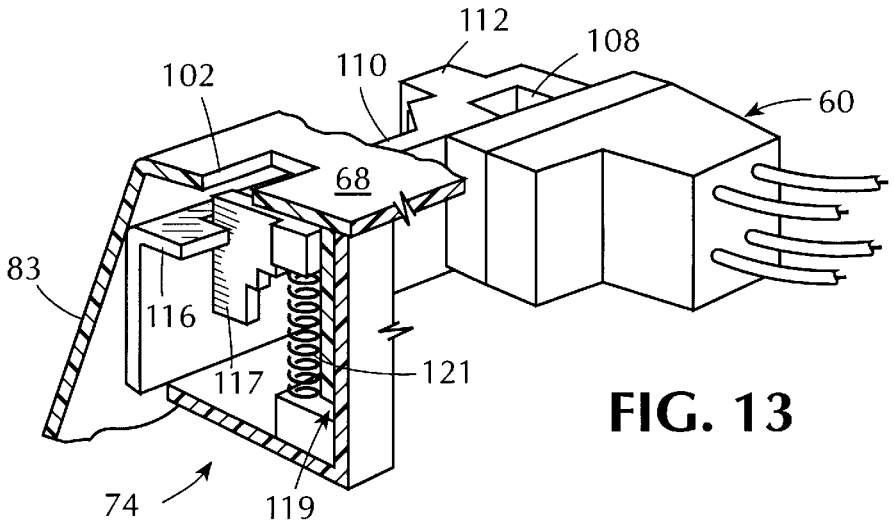
FIGS. 13–15 are section views of the portion of the molding toy depicted in FIG. 1 near the slide switch mounted to the front wall thereof which controls power to the heating device of the toy, FIG. 13 showing the cover to the base opened and the switch in the off position, FIG. 14 showing the outer cover to the base closed and the switch in the off position, and FIG. 15 showing the outer cover closed and the switch in the on position.
Figure 14:
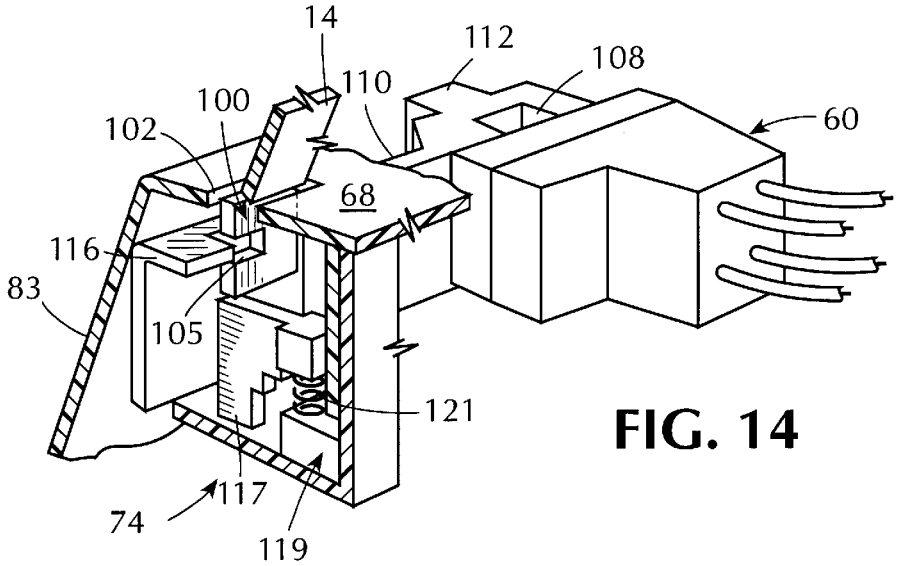
Figure 15:
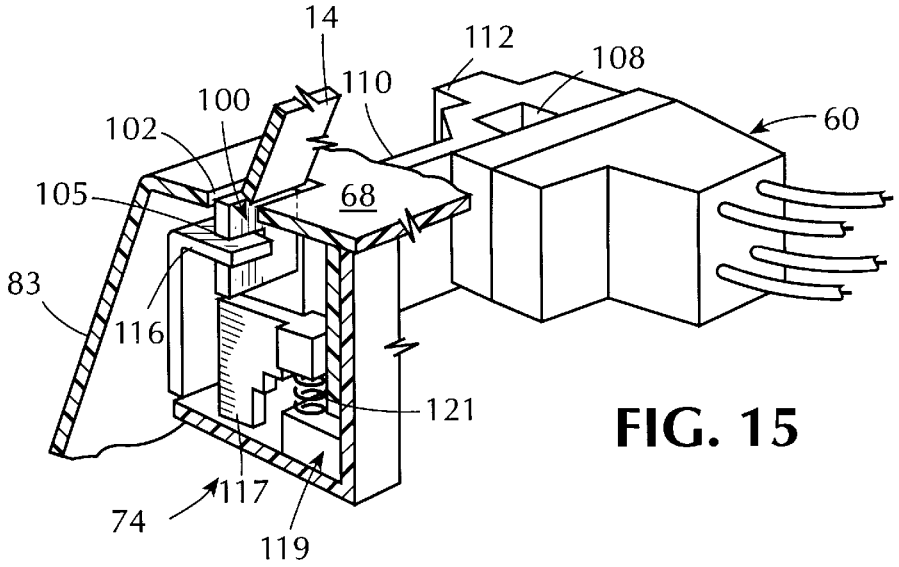

Referring to FIGS. 13–15, the switch interlock 74 prevents the switch 60 from being switched to its on position unless the outer cover 14 is closed and prevents the outer cover 14 from being pivoted open from the closed position if the switch 60 is not in its off position. As shown in FIG. 2, the outer cover 14 has another projecting tab 100 depending from the front edge thereof which enters an opening 102 in the top edge of the base front wall 83 adjacent the switch 60 when the cover 14 is closed. The tab 100 has a beveled portion 104 (FIG. 2) extending perpendicular to the edge of the cover and a slot 105 opening in the side of the tab.

Referring to FIG. 5, the switch 60 has a slide button or lever 107 which enters a receptacle 108 (FIGS. 13–15) in one end of a slide plate 110 mounted for sliding movement along the inside of the front of the base 12. The slide plate 110 has a button 112 (FIGS. 1 and 2) which projects from a slotted hole 114 in the base front wall 83. Sliding the button 112 switches the state of the switch 60. FIG. 13 shows the slide button 112 to the left in the off position of the switch 60. The on position is to the right from the position shown in FIG. 13. As shown in FIG. 13, a first locking tab 116 projects from the other end of the slide plate 110 away from the base front wall 83, and a second locking tab 117 is mounted in a track 119 projecting downwardly from the top 68 of the base 12 for slidable movement into and out of engagement with the first locking tab 116. A coil spring 121 positioned in the track 119 urges the second locking tab towards and into engagement with the first locking tab when the outer cover 14 is open, as shown in FIG. 13. With the outer cover 14 open, this prevents the slide plate from being moved to the right towards the on position of the switch 60.

Referring to FIG. 14, as the outer cover 14 is closed, the tab 100 depending therefrom contacts the top of the second locking tab 117 and pushes it out of engagement with the first locking tab. The beveled portion 104 contacts and slidably engages the edge of the opening 102 for a tight closure fit. The open slot 105 in the cover tab 100 is positioned in alignment with the first locking tab 116 on the slide plate 110, which now allows the slide plate 110 to be moved to the right from the position in FIG. 13 to engage the first locking tab 116 in the open slot 105 and switch the switch 60 on, as shown in FIG. 15. Engagement of the first locking tab 116 in the open slot 105 prevents the outer cover 14 from being moved out of its closed position while the switch 60 is in the on position (FIG. 14). Sliding the slide plate 110 to the left from the switch on position of FIG. 15 to the switch off position of FIG. 14 allows the outer cover 14 to be opened.

Figure 6:
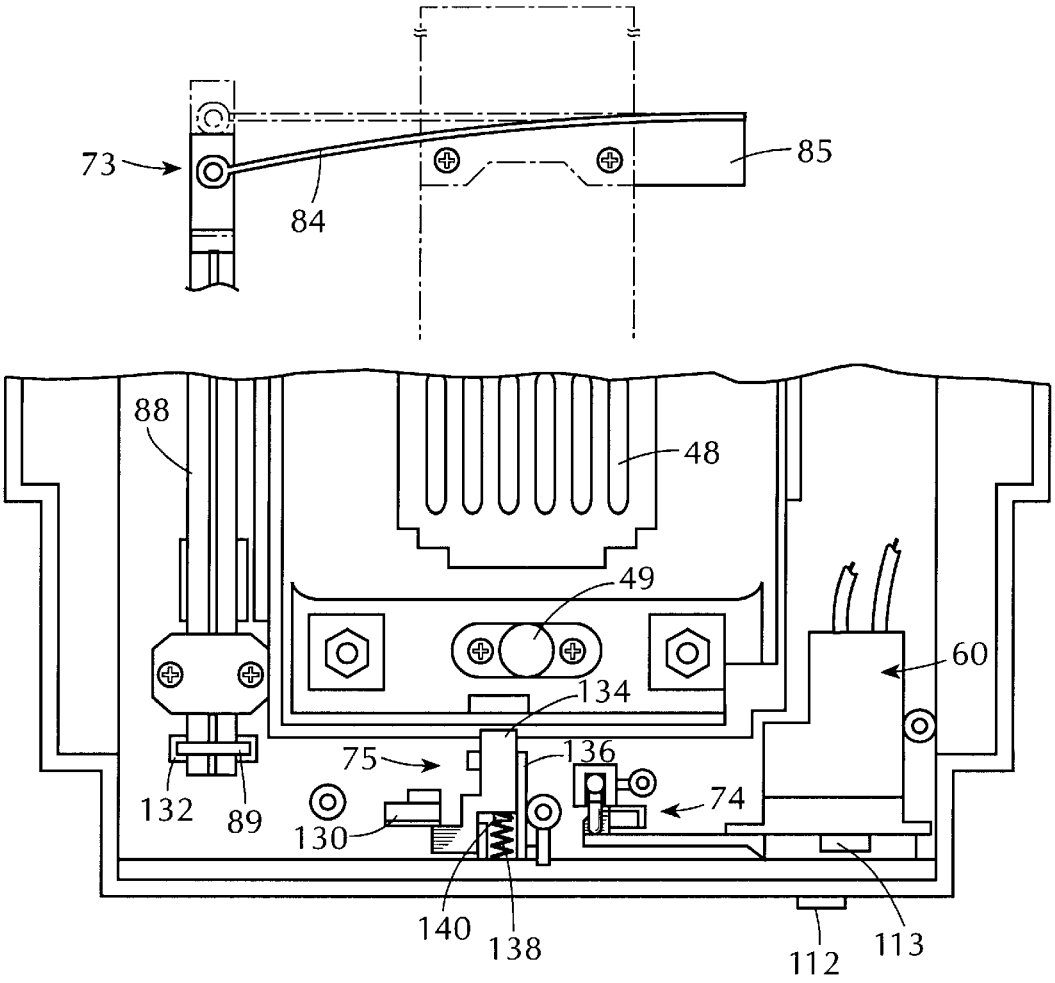
FIG. 6 is a view similar to that of FIG. 5 of a portion of the molding toy shown in FIG. 5 but with the heat responsive interlock and the molding platform interlock in second locked positions thereof.
Figure 6A:
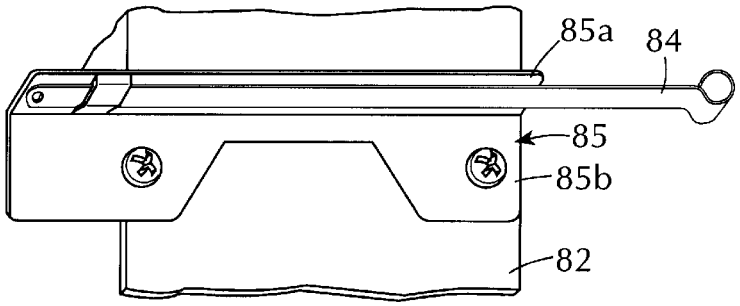
FIG. 6A is a perspective view of part of the temperature responsive interlock of the molding toy depicted in FIG. 1.

Referring to FIGS. 5, 6 and 9 the molding platform interlock 75 prevents the molding platform from being tilted unless the outer cover 14 is its closed position. A locking tab 134 is slidably mounted in a track 136 extending along the top 68 of the base 12 for slidable movement into and out of engagement with the molding platform 16. FIG. 5 shows the locking tab 134 engaged with the molding platform with the cover 14 open, and FIG. 6 shows the locking tab 134 retracted out of engagement with the molding platform with the cover 14 closed. A coil spring 138 positioned in the track 136 about a pin 140 projecting from the locking tab 134 urges the locking tab 134 towards and into engagement with molding platform 16 when the outer cover 14 is open, as shown in FIG. 5. This prevents the molding platform from being tilted when the outer cover is open.

As shown in FIG. 2, the outer cover 14 has another projecting tab 130 depending from the front edge thereof which enters an opening 132 in the top edge of the base front wall 83 in the region of the molding platform 16. Referring to FIG. 6, as the outer cover 14 is closed, the tab 130 depending therefrom contacts the locking tab 134 and pushes it away from and out of engagement with the molding platform 16. The edge of the cover tab 130 and the edge of the locking tab 134 contacted by the cover tab 130 are beveled and provide a camming action to push the locking tab 134 against the action of the spring 138 away from the molding platform 16. With the outer cover 14 closed, the molding platform 16 may be tilted by the crank 63 provided that the crank/cover interlock 76 described below permits the crank 63 to be rotated. When the outer cover 14 is opened, the spring 138 pushes the locking tab 134 back into engagement with the molding platform 16 to prevent tilting thereof while the outer cover is open.

The crank/cover interlock 76 (FIG. 11) prevents the crank 63 from rotating (to prevent tilting of molding platform 16)

unless the outer cover 14 is in its closed position, and also prevents the outer cover from being opened if the crank wheel 69 is not in a home or locked position. Referring to FIGS. 7, 8, 11 and 12, attached to the crank shaft coupling 71 is a segment 160 of a disc or ring from which a locking arm 161 circumferentially extends. A circumferential slot 162 is formed between the hub 163 of the coupling 71 and the locking arm 161.

As shown in FIGS. 11 and 12, the interlock 76 includes a spring loaded locking tab 165 mounted in a track 167 suspended from the top 68 of the base 12 for slidable movement towards and away from the locking arm 161. A coil spring 169 is positioned within the track 167 mounted in an annular space defined by a cylindrical bore (not shown) and a concentric pin 171 projecting from the bore. Bearing against the track, the spring 169 urges the locking tab 165 towards and into engagement with the end 176 (FIG. 7), of the locking arm 161 when the outer cover 14 is open, as shown in FIG. 12. With the outer cover 14 open, this prevents the crank 63 from being rotated, and correspondingly, the molding platform 16 from being tilted.

Figure 7:
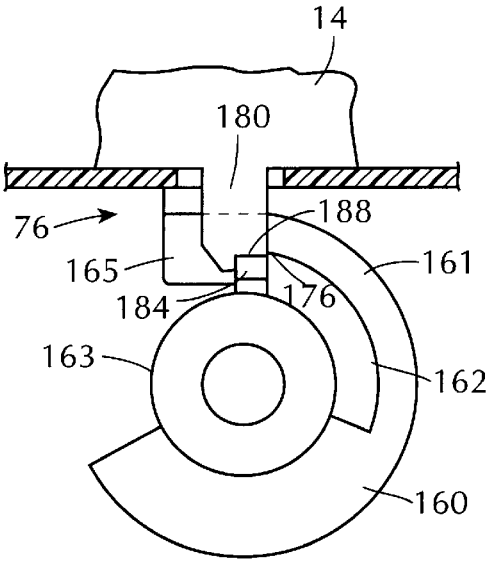
FIG. 7 is a section view of the molding toy depicted in FIG. 1 taken through line 7—7 in FIG. 1 showing a crank/cover interlock which prevents tilting of the platform when the outer cover is not in its closed position or the crank in a locked or home position.

As shown in FIGS. 2, 7–8 and 11, the outer cover 14 has another projecting tab 180 depending from the side edge thereof which enters an opening 182 in the top edge of the base side wall 174 adjacent the crank 63 when the cover is closed. The tab 180 has a tooth 184 (FIG. 7) projecting from the end thereof which includes an inclined inner surface 185 (FIG. 2) and defines a shoulder 188 extending perpendicular to the side of the tab 180. With reference to FIGS. 7 and 11, the tab 180 enters the opening 182 as the outer cover 14 is closed, with the inclined surface 185 of the tab contacting an oppositely inclined surface 190 on the spring loaded locking tab 165 in the base 12 and camming the locking tab 165 out of engagement with the locking arm 161 when the cover 14 is closed. However, the crank 63 still may not be rotated because now the tooth 184 on the cover tab 180, instead of the spring-loaded locking tab 180, engages the end 176 of the locking arm 161 (as shown in FIG. 7 but not in FIG. 11). In this configuration, the outer cover 14 may be opened if the temperature responsive interlock 73 and the switch interlock 74 are not engaged.

In order to rotate the crank 63 after closing the outer cover 12, the crank 63 has to be moved away from the side wall 174. To permit such axial movement of the crank wheel 69, the pivot pin 65*a* is slidably received in the coupling 71, as mentioned above. FIG. 11 shows the crank wheel 69 moved axially away from the side wall 174 sufficiently for the locking arm 161 to clear the cover tab 180 so that the crank 63 may be rotated.

Figure 8:
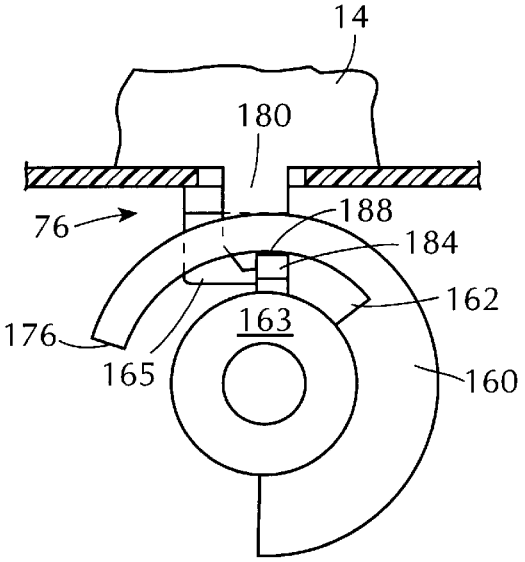
FIG. 8 is a section view similar to that of FIG. 7 showing the crank/cover interlock in an unlocked position.

After outward axial movement of the crank wheel 69, initial rotation of the crank 63 causes the tooth 184 on the cover tab 180 to enter the circumferential slot 162 (FIG. 8) on the disc segment 160, which locks the cover 14 closed. Thus, even if the switch 60 is off and the temperature responsive interlock 73 is not engaged, the outer cover 14 can not be opened once the molding platform is tilted. The angle of rotation of the crank 63 is limited by engagement of the tab tooth 184 in the end of the circumferential slot 162, as illustrated in FIG. 8, which allows the molding platform 16 to tilt to the position shown in FIG. 9. When the crank 63 is rotated back to the position shown in FIGS. 7 and 11, the tooth 184 moves out of the circumferential slot 162, and the cover 14 may be again opened (if the temperature responsive interlock 73 and the switch interlock 74 are not engaged).

The crank 63 also has a spring loaded detent referenced generally by 190 shown in FIGS. 11A and 11B, which locks the crank wheel 69 in its home position in which the molding platform 16 is horizontal. The detent 190 comprises a hole 191 in the side wall 174, a rod 192, and a coil spring 193. The rod 192 is spring loaded in the interior of the crank handle 64 for slidable movement towards and away from the side wall under action of the spring 193. The hole 191 is located to be axially aligned with the crank handle 64 in the home position of the crank so that the rod 192 is urged into the hole 191 to lock the crank wheel 69.

Pulling the crank handle 64 away from the side wall 174 pulls the post 192*a* of the rod 192 out of the hole 191 and allows the crank wheel 63 to be rotated. The face of the post 192*a* rides on the side wall 174 as the crank wheel 63 is rotated. When the crank wheel 63 is rotated back to the home position, the spring 193 pushes the post 192*a* of the rod 192 back into the hole 191. Pulling the crank handle 64 away from the side wall 174 also pulls the crank wheel 69 away from the side wall 174 to disengage the locking arm 161 from the cover tab 180 (not shown but see FIG. 11), and in reverse order, seating of the post 192*a* in the hole 191 in the home position of the crank wheel 63 moves the locking arm 161 into engagement with the cover tab 180 as shown in FIG. 11 and described above.

While the invention has been described and illustrated in connection with preferred embodiments, many variations and modifications as will be evident to those skilled in this art may be made without departing from the spirit and scope of the invention. The invention as set forth in the appended claims is thus not to be limited to the precise details of construction set forth above as such variations and modifications are intended to be included within the spirit and scope of the invention as defined in the appended claims.

We claim:

1. A molding toy comprising:

a crucible mounted to said toy movable between a first position in which liquid molding material therein of a given amount does not flow therefrom and a second position in which liquid molding material therein of the given amount flows therefrom;

a heating device in a heat transforming relationship with said crucible;

a mold removably mounted to said toy which in a first position thereof receives liquid molding material flowing from said crucible in said second position thereof;

a cover mounted to said toy movable between a first position preventing access at least to said mold and a second position allowing access at least to said mold sufficient to allow mounting of said mold and removal of said mold; and an interlock coupled to said cover to prevent said cover from being moved from said first position when a temperature in said toy is greater than a given temperature.

2. The molding toy of claim 1, wherein said mold has a plurality of mold parts which together define a closed mold having an inlet through which molding material enters said mold, said mold being mounted to said toy such that in said first position thereof molding material flowing from said crucible in said second position thereof enters said inlet.

3. A molding toy comprising:

a crucible;

a heating device in a heat transferring relationship with said crucible;

a mold receptacle in which a mold is removably seated;

said crucible and said mold receptacle being mounted to said toy in a fixed relationship with each other movable together between a first position and a second position such that liquid molding material in said crucible of a given amount does not flow therefrom in said first position and liquid molding material in said crucible of the given amount flows therefrom into a mold in said mold receptacle in said second position;

a cover mounted to said toy movable between a first position preventing access at least to said crucible, said mold receptacle and any mold in said mold receptacle, and a second position allowing access at least to said crucible and said mold receptacle and any mold in said mold receptacle sufficient to allow insertion of a mold into and removal of a mold from said mold receptacle and introduction of molding material into said crucible; and an interlock coupled to said cover to prevent said cover from being moved from said first position when a temperature in said toy is greater than a given temperature.

4. The molding toy of claim 3 comprising a mold which can be inserted into and removed from said receptacle, said mold comprising a plurality of mold parts which together define a closed mold having an inlet through which molding material enters said mold, said mold being configured to position said inlet to receive liquid molding material flowing from said crucible when said mold is in said receptacle and said mold receptacle and said crucible are in said second position thereof.

5. A molding toy comprising:

a molding platform mounted to said toy for movement between a horizontal position and at least one inclined position;

a crucible carried by said molding platform to move therewith;

a heating device in a heat transferring relationship with said crucible;

a mold;

a mold receptacle in which said mold is removably seated, said mold receptacle being carried by said platform to move therewith;

said crucible and said mold receptacle being carried by said platform in a fixed relationship to each other such that liquid molding material flows from said crucible in said at least one inclined position of said platform into said mold in said mold receptacle;

a cover mounted to said toy movable between a first position preventing access at least to said crucible, said mold receptacle and any mold in said mold receptacle, and a second position allowing access at least to said crucible and said mold receptacle and any mold in said mold receptacle sufficient to allow insertion of a mold into and removal of a mold from said mold receptacle and introduction of molding material into said crucible; and an interlock coupled to said cover to prevent said cover from being moved from said first position when a temperature in said toy is greater than a given temperature.

6. The molding toy of claim 5 wherein said heating device is carried by said platform to move therewith in a fixed relationship with said crucible.

7. The molding toy of claim 5 wherein said mold comprises a plurality of mold parts which together define a closed mold.

8. A molding toy comprising:

a crucible mounted to said toy for movement between a horizontal position in which liquid molding material in said crucible of a given amount does not flow therefrom and at least one inclined position in which liquid molding material in said crucible of the given amount flows therefrom;

a heating device positioned to heat molding material in said crucible;

a mold mounted to said toy such that said mold receives liquefied molding material flowing from said crucible in said at least one inclined position of said crucible;

an inner cover movably mounted to cover at least said crucible in a first position thereof such that said inner cover substantially prevents escape of liquefied molding material through an open top of said crucible, and in a second position permits introduction of molding material into said crucible through said open top thereof;

an outer cover movably mounted to said toy which in a closed position thereof blocks access at least to said inner cover and in an open position thereof permits access at least to said inner cover; and a first interlock coupled to said outer cover to prevent said outer cover from being moved from said closed position when a temperature in said toy is greater than a given temperature.

9. The molding toy of claim 8 wherein said inner cover is removably mounted.

10. The molding toy of claim 8 wherein said outer cover is pivotally mounted.

11. The molding toy of claim 8 wherein said mold is positioned and said outer cover is configured to block access to said mold in said closed position of said outer cover.

12. The molding toy of claim 8 comprising a base to which said crucible, said mold and said cover are mounted, said first interlock comprising a temperature sensitive element positioned to be heated by heat generated by said heating device, a locking device having engaging portions associated with said outer cover and said base and an element movably mounted to said base which moves in response to said temperature sensitive element to cause said engaging portions to engage and disengage, said engaging portions when engaged preventing said outer cover from being moved out of said closed position and when disengaged permitting said outer cover to be moved out of said closed position.

13. The molding toy of claim 8 comprising a second interlock which prevents said crucible from being moved when said outer cover is not in its closed position, said second interlock comprising portions which engage and disengage in response to movement of said outer cover into and out of said closed position.

14. The molding toy of claim 8 comprising a switch having on and off states for respectively coupling and decoupling electrical power to said heating device, and a second interlock which prevents electrical power from being coupled to said heating device when said outer cover is not in said closed position.

15. The molding toy of claim 14 wherein said switch has an activating member which is moved between on and off positions to change the state of said switch, said second interlock comprising a movable member which in a first position thereof engages said activating member of said switch in the off position thereof and prevents movement of said switch activating member, and which in a second position thereof permits movement of said activating member between said on and off positions thereof, and said outer cover has a portion which moves said movable member of said interlock into said first and second positions thereof to engage and disengage said switch activating member when said outer cover is moved into and out of said closed position, respectively.

16. The molding toy of claim 15 wherein said portion of said outer cover and said switch activating member have engaging structure which engage when said outer cover is in said closed position and said switch activating member is in said on position to prevent said outer cover from being moved out of said closed position when said switch activating element is in said on position.

17. The molding toy of claim 8 comprising a second interlock that prevents moving of said crucible unless the outer cover is in said closed position.

18. The molding toy of claim 17 comprising a base to which said outer cover is mounted, and wherein said crucible is mounted to a carrier pivotally mounted to said base to pivotally mount said crucible to said base, said second interlock comprising a locking tab slidably mounted to said base to move into and out of engagement with said carrier, said locking tab preventing pivoting of said carrier when engaged therewith, a spring urging said locking tab into engagement with said carrier when said outer cover is not in said closed position, and an activating element carried by said outer cover positioned to contact and move said locking tab out of engagement with said carrier when said cover is in said closed position.

19. The molding toy of claim 8 comprising a crank coupled to said carrier to pivot said crucible upon rotation of said crank.

20. The molding toy of claim 19 comprising a second interlock which prevents rotation of said crank unless said outer cover is in said closed position.

21. The molding toy of claim 20 wherein said second interlock comprises a locking tab slidably mounted to said base to move into and out of engagement with said crank, said locking tab preventing rotation of said crank when engaged therewith, a spring urging said locking tab into engagement with said crank when said outer cover is not in said closed position, and an activating element carried by said outer cover positioned to contact and move said locking tab out of engagement with said crank when said cover is in said closed position.

22. The molding toy of claim 19 comprising a second interlock which prevents opening of said outer cover unless said crank is in a home position thereof corresponding to the horizontal position of said crucible.

23. The molding toy of claim 22 wherein said second interlock comprises a locking tab carried by said outer cover and engaging structure on said locking tab and said crank which engage when said crank is not in said home position to prevent said outer cover from being moved out of its closed position and which disengage when said crank is in said home position.

24. A molding toy comprising:

a base;

a crucible pivotally mounted to said base for movement between a horizontal position and at least one inclined position, said crucible having an outlet;

a heating device positioned to heat molding material in said crucible;

a mold mounted to said base such that said mold receives liquefied molding material flowing through said crucible outlet in said at least one inclined position of said crucible;

an inner cover movably mounted to said base which in a first position covers at least said crucible such that said cover substantially prevents escape of liquefied molding material through an open top of said crucible, and in a second position permits introduction of molding material into said crucible through said open top thereof;

an outer cover movably mounted to said base which in a closed position thereof blocks access to said inner cover and in an open position thereof permits access to said inner cover;

a first interlock responsive to temperature comprising a temperature sensitive element positioned to be heated by heat generated by said heating device and structure responsive to said temperature sensitive element to prevent moving said outer cover out of its closed position if the temperature of the temperature sensitive element is above a given temperature; and a second interlock comprising structure selectively engaging said crucible to preventing pivoting of said crucible when said outer cover is not in its closed position.

25. A molding toy comprising:

a base;

a crucible pivotally mounted to said base for movement between a horizontal position and at least one inclined position, said crucible having an outlet;

a heating device positioned to heat molding material in said crucible;

a mold mounted to said base such that said mold receives liquefied molding material flowing through said crucible outlet in said at least one inclined position of said crucible;

an inner cover movably mounted to said base which in a first position covers at least said crucible such that said cover substantially prevents escape of liquefied molding material through an open top of said crucible, and in a second position permits introduction of molding material into said crucible through said open top thereof;

an outer cover movably mounted to said frame which in a closed position thereof blocks access to said inner cover and in an open position thereof permits access to said inner cover;

a first interlock responsive to a temperature in or near said crucible which prevents movement of at least one of the covers out of the first or closed position thereof when said temperature is above a given temperature and permits movement of the respective cover out of the first or closed position when said temperature is below said given temperature; and a second interlock responsive to the position of at least one of said covers which prevents pivoting of said crucible when said outer cover is not in said closed position and permits pivoting of said crucible when said outer cover is in said closed position.

26. The molding toy of claim 25 comprising a crank mechanism coupled to said crucible to pivot said crucible between said horizontal position and said at least one inclined position, and wherein said second interlock selectively engages said crank to prevent and permit rotation thereof.

27. A molding toy comprising:

a mold mounted to said toy;

a crucible in which molding material is heated mounted to said toy and from which liquid molding material is selectively transferred to said mold;

a heating device mounted to said toy in a heat-transferring relationship with said crucible;

at least one safety device which selectively prevents access to parts of the molding toy to which access is required to operate the toy that can reach a temperature above which it is unsafe for a child to handle such parts in response to a temperature in said toy greater than a given temperature.

28. A molding toy comprising:

a base;

a crucible pivotally mounted to said base for movement between a horizontal position and at least one inclined position;

a mold mounted to said base such that said mold receives liquefied molding material flowing from said crucible in said at least one inclined position of said crucible;

an inner cover movably mounted to said base which in a first position covers at least said crucible such that said inner cover substantially prevents escape of liquefied molding material through an open top of said crucible, and in a second position permits introduction of molding material into said crucible through said open top thereof;

an outer cover movably mounted to said base which in a closed position thereof blocks access to said inner cover and in an open position thereof permits access to said inner cover;

a heating device positioned to heat molding material in said crucible; and an interlock responsive to temperature comprising a temperature sensitive element positioned to be heated by heat generated by said heating device, a locking device having engaging portions associated with said outer cover and said base and an element movably mounted to said base which moves in response to said temperature sensitive element to cause said engaging portions to engage and disengage, said engaging portions when engaged preventing said outer cover from being moved out of said closed position and when disengaged permitting said outer cover to be moved out of said closed position.

29. A molding toy comprising:

a base;

a crucible mounted to said base for movement between a horizontal position and at least one inclined position;

a heating device positioned to heat molding material in said crucible;

a mold mounted to said base such that said mold receives liquefied molding material flowing from said crucible in said at least one inclined position of said crucible;

an inner cover movably mounted to said base which in a first position covers at least said crucible such that said inner cover substantially prevents escape of liquefied molding material through an open top of said crucible, and in a second position permits introduction of molding material into said crucible through said open top thereof;

an outer cover movably mounted to said base which in a closed position thereof blocks access to said inner cover and in an open position thereof permits access to said inner cover; and an interlock which prevents said crucible from being moved to said at least one inclined position when said outer cover is not in its closed position, said interlock comprising portions which engage and disengage in response to movement of said outer cover into and out of said closed position.

30. A molding toy comprising:

a base;

a crucible mounted to said base for movement between a horizontal position and at least one inclined position;

a mold mounted to said base such that said mold receives liquefied molding material flowing from said crucible in said at least one inclined position of said crucible;

an inner cover movably mounted to said base which in a first position covers at least said crucible such that said inner cover substantially prevents escape of liquefied molding material through an open top of said crucible, and in a second position permits introduction of molding material into said crucible through said open top thereof;

an outer cover movably mounted to said base which in a closed position thereof blocks access to said inner cover and in an open position thereof permits access to said inner cover;

a heating device positioned to heat molding material in said crucible;

a switch having on and off states for respectively coupling and decoupling electrical power to said heating device; and an interlock which prevents electrical power from being coupled to said heating device when said outer cover is not in said closed position.

31. A molding toy comprising:

a base;

a crucible mounted to said base for movement between a horizontal position and at least one inclined position;

a heating device positioned to heat molding material in said crucible;

a mold mounted to said base such that said mold receives liquefied molding material flowing from said crucible in said at least one inclined position of said crucible;

an inner cover movably mounted to said base which in a first position covers at least said crucible such that said inner cover substantially prevents escape of liquefied molding material through an open top of said crucible, and in a second position permits introduction of molding material into said crucible through said open top thereof;

an outer cover movably mounted to said base which in a closed position thereof blocks access to said inner cover and in an open position thereof permits access to said inner cover; and an interlock that prevents movement of said crucible to said at least one inclined position unless the outer cover is in said closed position.

32. A molding toy comprising:

a base;

a crucible mounted to said base for movement between a horizontal position and at least one inclined position;

a heating device positioned to heat molding material in said crucible;

a mold mounted to said base such that said mold receives liquefied molding material flowing from said crucible in said at least one inclined position of said crucible;

an inner cover movably mounted to said base which in a first position covers at least said crucible such that said inner cover substantially prevents escape of liquefied molding material through an open top of said crucible, and in a second position permits introduction of molding material into said crucible through said open top thereof;

an outer cover movably mounted to said base which in a closed position thereof blocks access to said inner cover and in an open position thereof permits access to said inner cover;

a crank coupled to said crucible to move said crucible to said at least one inclined position upon rotation of said crank; and an interlock which prevents rotation of said crank unless said outer cover is in said closed position.

33. A molding toy comprising:

a base;

a crucible mounted to said base;

a heating device mounted to said base to heat molding material in said crucible;

a closed mold having an inlet through which a flowable molding material can flow;

a mold receptacle mounted to said base in which said mold is removably received;

said mold receptacle and said crucible being relatively positioned such that in a tilted position of said crucible, molding material can flow from said crucible into said inlet of said mold in said mold receptacle; and a cover mounted to said base and an interlock therefor which cooperate to limit access to parts of said toy where temperature can rise above a given temperature during operation of said toy.

34. A molding toy comprising:

a mold mounted to said toy;

a crucible in which molding material is heated mounted to said toy and from which liquid molding material is selectively transferred to said mold;

a heating device mounted to said toy in a heat-transferring relationship with said crucible;

a cover mounted to said toy movable between a first position preventing access at least to said mold and a second position allowing access at least to said mold sufficient to allow mounting of said mold and removal of said mold; and at least one safety device which prevents transfer of molding material from said crucible to said mold when said cover is not in said first position.

* * * * *

UNITED STATES PATENT AND TRADEMARK OFFICE

CERTIFICATE OF CORRECTION

PATENT NO. : 5,954,115

DATED : September 21, 1999

INVENTOR(S) : Steven Lebensfeld, et al

It is certified that error appears in the above-identified patent and that said Letters Patent is hereby corrected as shown below:

On the Title Page insert, ------ Item [73] Assignee: Toymax Inc., Plainview, New York ------.

Signed and Sealed this

Third Day of April, 2001

*Attest:*

Nicholas P. Godici

NICHOLAS P. GODICI

*Attesting Officer*

*Acting Director of the United States Patent and Trademark Office*